US005130686A

United States Patent [19]

Leupold

[11] Patent Number: 5,130,686

[45] Date of Patent: Jul. 14, 1992

[54] MAGNETIC FIELD SHAPER

[75] Inventor: Herbert A. Leupold, Eatontown, N.J.

[73] Assignee: The United States of America as represented by the Secretary of the Army, Washington, D.C.

[21] Appl. No.: 650,544

[22] Filed: Feb. 5, 1991

[51] Int. Cl.[5] ..... H01F 1/00

[52] U.S. Cl. ..... 335/216; 335/296; 505/879

[58] Field of Search ..... 335/216, 296, 299; 505/1, 879; 29/599

[56] References Cited

U.S. PATENT DOCUMENTS 4,969,064 11/1990 Shadowitz ..... 335/216

FOREIGN PATENT DOCUMENTS 58-140102 8/1983 Japan ..... 335/216

1-162309 6/1989 Japan ..... 335/216

*Primary Examiner*—Leo P. Picard

*Assistant Examiner*—Trinidad Korka

*Attorney, Agent, or Firm*—Michael Zelenka; William H. Anderson

[57] ABSTRACT

The coil of a solenoid has a pair of cylindrical, superconductive bands placed coaxially about its exterior. The bands are mounted for movement axially along the outer surface of the coil. The bands are used to shape and redirect the flux lines of the solenoid. The bands are placed near the midpoint of the coil. Sufficient current is applied to the coil to immerse the bands in a field greater than the critical field Hc, thereby switching off the superconductive state of the bands and causing flux lines from the coil to intersect the bands. Next, the field is reduced below the critical field Hc, switching on the superconductive state of the bands. The bands are then moved to the ends of the coil, reshaping the field of the solenoid into a more uniform configuration as they move. In an alternate embodiment, the superconductive state of the bands is switched on by lowering their temperature below the critical temperature while the coil is producing its desired or working field.

4 Claims, 3 Drawing Sheets

MAGNETIC FIELD SHAPER

GOVERNMENT INTEREST

The invention described herein may be manufactured, used, and licensed by or for the Government for governmental purposes without the payment to me of any royalties thereon.

BACKGROUND OF THE INVENTION

1. Field of the Invention

The present invention relates to magnets having a field-shaping mechanism. More particularly, it relates to apparatus and methods for reshaping magnetic fields by bending, straightening or otherwise flexing flux lines from their original position.

2. Description of the Prior Art

The use of magnetic claddings and cores to shape or concentrate the magnetic field of a magnet is known. Such claddings are often used to produce a magnetic field having a desired configuration. For example, tubular solenoids are often clad with cylindrical metal cases for improved magnetic circuit return as well as coil protection. These dc solenoids offer high volumetric efficiency and, as such, they are often specified for industrial and military/aerospace equipment where space is at a premium. They are used in printers, computer disks and tape drives, and military weapons systems. Those concerned with the development of such solenoids have routinely used claddings made of metal such as iron to shape and direct the solenoid fields so as to closely approximate the field of an ideal solenoid.

The ideal solenoid is often viewed as an infinitely long, current-carrying wire wound in the form of a close-packed helix. Essentially, the ideal solenoid is an infinitely long conductive cylinder in which a sheet of current flows that produces a uniform magnetic field having induction lines that are parallel for all points inside the cylinder and wherein the field is essentially zero for all points outside the cylinder, the field lines closing on themselves at infinity.

In many applications, solenoids of finite length are good approximations of the ideal solenoid for points close to the solenoid axis and for external points near the central region of the solenoid, that is, away from the ends. The approximation becomes better for a solenoid wherein its length is much greater than its diameter. However, in many applications, increasing the length of a solenoid becomes impractical. It is for this reason that those skilled in these arts have often used magnetic claddings, cores, and other means to help direct the solenoid field into a near uniform configuration more like the ideal case. Although, such prior art devices have served the purpose, they have not proved entirely satisfactory under all conditions of service for the reason that the added bulk and weight of claddings and similar devices make their use impractical in many applications. Additionally, claddings and cores can provide only a limited degree of field shaping.

SUMMARY OF THE INVENTION

The general purpose of this invention is to provide a device and method of shaping the magnetic field induction lines of a magnetic circuit. To attain this, the present invention contemplates a unique superconducting mechanism which is used to selectively direct the magnetic field of a magnet.

In general, the invention includes a magnetic field shaper having a pair of bands of superconductive material. The bands are fixed in a first position about a magnetic field source while in a non-superconductive state. The bands are then made superconductive while the magnetic field source generates a magnetic field. As the bands become superconductive they will trap a cross section of the flux lines. The bands are then moved with respect to the magnetic field source to a second position. As the bands are moved, the flux lines of the magnet are redirected and shaped into a new configuration.

More specifically, the bands are cylindrically shaped and exteriorly placed at the mid-point of a similarly shaped magnetic coil of a conventional solenoid. The superconductive state of the bands is off while current passes through the coil and flux lines thread the bands. Next, the superconductive state of the bands is turned on and the threading flux lines are trapped. The bands are then moved to the ends of the coil, reshaping the flux lines of the coil as they move. The final configuration of the flux lines closely approximates the uniform field of a solenoid having a significantly greater length.

An object of the present invention is the provision of an apparatus that can shape and redirect the induction lines of a magnet.

Another object is to provide a magnetic field straightener that can be used to straighten the internal field lines of a finite coil, such as found in a solenoid, to more closely approximate the field of an infinitely long coil.

A further object of the invention is the provision of a method of bending magnetic field lines in such magnetic devices as solenoids and the like.

Other objects and many of the attendant advantages of this invention will be readily appreciated or the same becomes better understood by reference to the following detailed description when considered in connection with the accompanying drawings in which like reference numerals designate like parts throughout the figures thereof.

DETAILED DESCRIPTION OF THE PREFERRED EMBODIMENT

Figure 1:
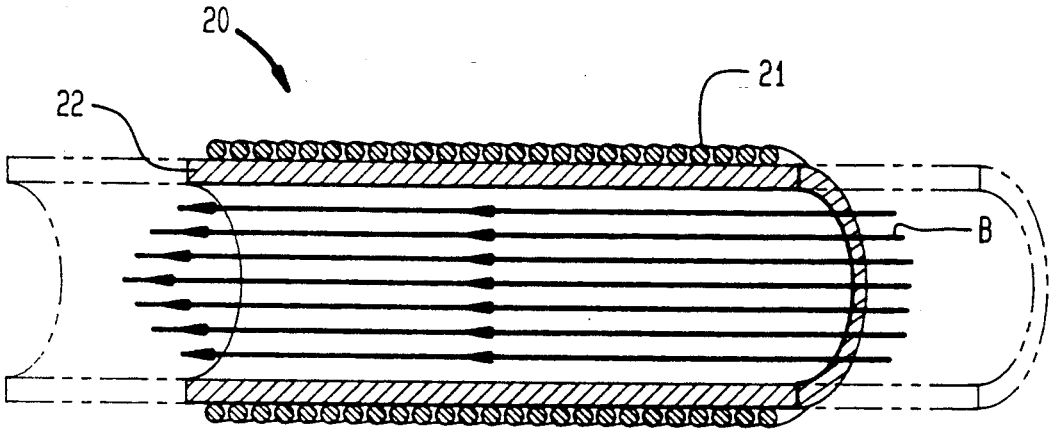
FIG. 1 (PRIOR ART)
FIG. 1 illustrates a sectional view of an ideal solenoid showing the associated flux lines.

Referring now to the drawings, there is shown in FIG. 1 an ideal electromagnet 20 having a coil 21 formed as an infinitely long, close-packed helix for carrying a current. Essentially, the coil 21 is viewed as an infinitely long cylindrical current sheet that produces a field B that is everywhere parallel for all points inside the coil 21 and is zero for all exterior points. The coil 21 is shown wound on a hollow cylindrical supporting form 22. For the magnet 20, the magnitude of the field B depends on the number of coil turns per unit of length, the current in the coil 21 and the permeability constant. The magnitude of field B does not depend on the solenoid diameter.

For many applications, a conventional solenoid having a coil of finite length, is a good approximation of the ideal structure FIG. 1). Electromagnet 25 (FIG. 2) includes a coil 26 having a finite number of turns wound on a form 29. The coil 26 has terminals 27, 28 at either end for connecting the coil 26 to a source of current (not shown). For internal points near the center of the finite coil 26, the field B is nearly parallel and closely approximates that of the infinite coil 21. However, for internal points away from the center of the finite coil 26, the field B will deviate significantly from that of the infinite coil 21 (FIG. 1).

Figure 2:
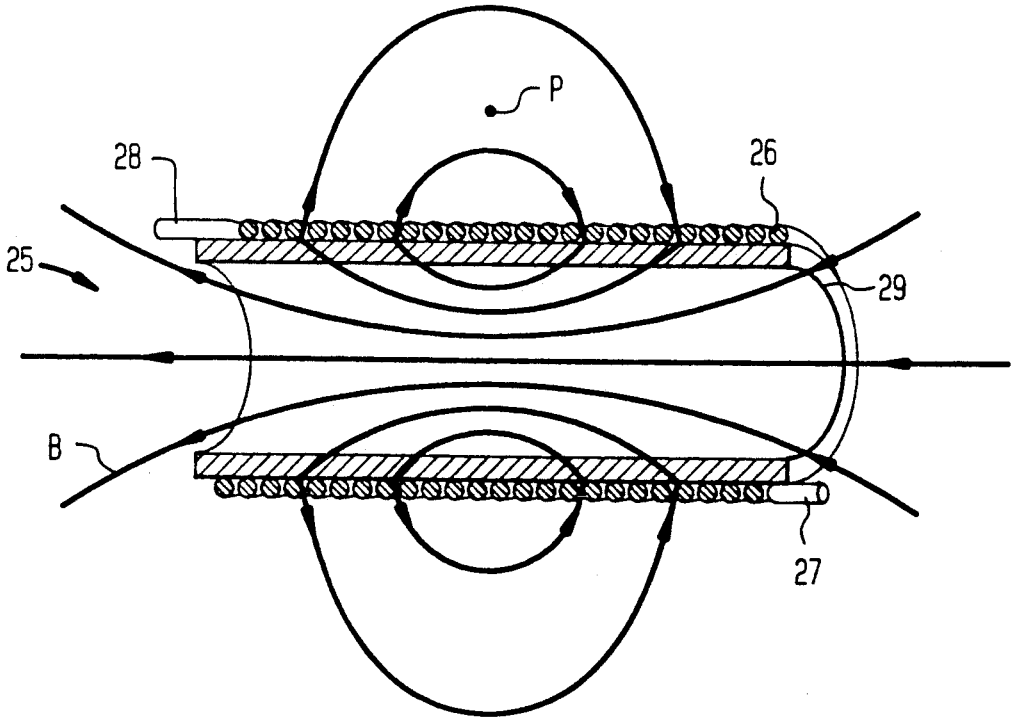
FIG. 2 (PRIOR ART)
FIG. 2 illustrates a prior art solenoid in section with the associated flux lines.

Also, for external points, such as point P in FIG. 2, the field B approximates zero if the length of coil 26 is much greater than its diameter and only external points near the central region of the coil 26 are considered, that is, points away from the ends. FIG. 2 schematically shows the flux lines for field B.

The preferred embodiment of FIGS. 3A–3D depicts a structure and method capable of shaping the flux lines of a magnet such as the coil 26. FIGS. 3A–3D show electromagnet 30 having superconducting cylindrical bands 31, 32 slidably mounted coaxially on the outside of the coil 26. When the bands 31, 32 are in a superconducting state, magnetic flux will be almost totally excluded from their interiors. If the superconductivity is destroyed by, for example, raising the temperature of bands 31, 32 or raising the ambient field above a critical field Hc, flux can penetrate the interior of bands 31, 32. The present invention contemplates using this unique property of the superconductive bands 31, 32 to reshape or straighten the flux lines of coil 26.

Figure 3A:
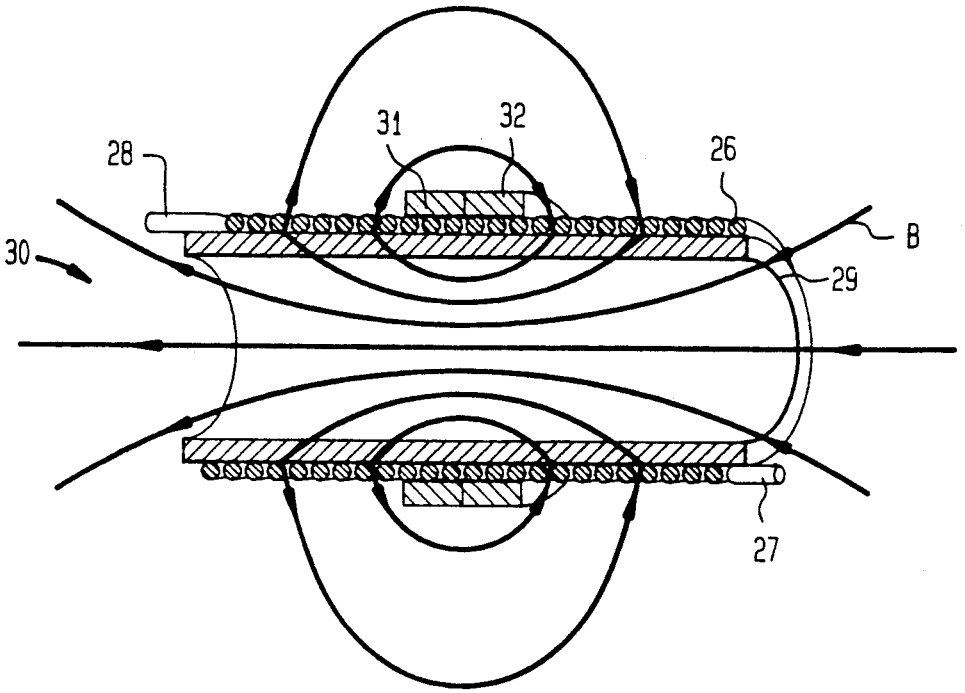
FIGS. 3A–3D show sectional views of the preferred embodiment at various stages.

In one embodiment, the bands 31, 32 are first placed near the midpoint of the coil 26 where the flux at the exterior of coil 26 is a minimum (FIG. 3A). At this point, current is applied to the coil 26 via current source 35 (FIG. 3D) and the terminals 27, 28, thereby immersing the bands 31, 32 in a magnetic field (FIG. 3A). When the immersing field exceeds the critical field Hc, the bands 31, 32 will leave the superconducting state and the flux lines will pass through bands 31, 32. The transition from superconducting to non-superconducting in some materials will be abrupt at the critical field Hc and in other materials the transition will be gradual.

Next the current in the coil 26 is reduced via current source 35 (FIG. 3D) so that the field passing through bands 31, 32 falls below the critical field Hc. At this point the bands 31, 32 will become superconductive and the flux associated with the critical field Hc that threads the bands 31, 32 at transition will be trapped in the bands 31, 32.

Figure 3B:
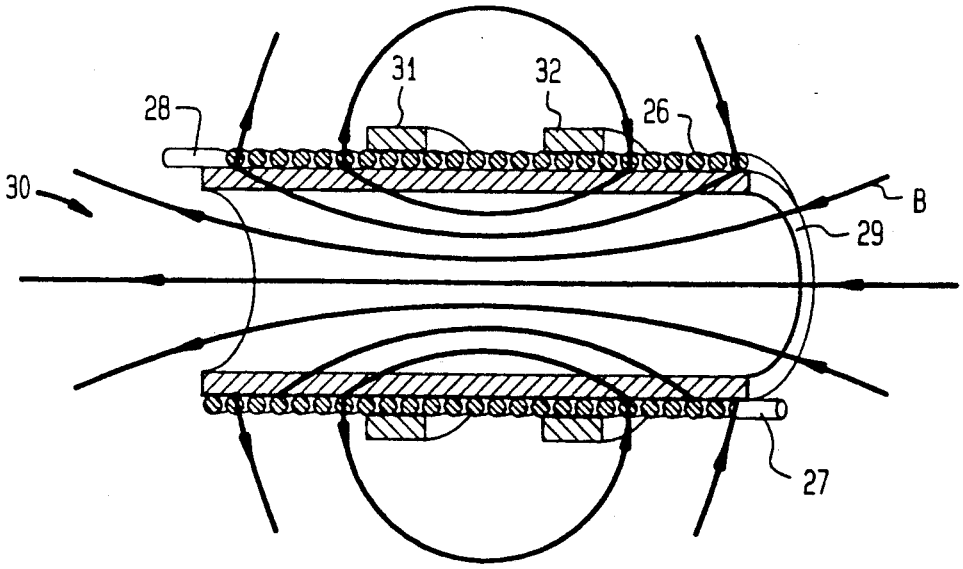
Figure 3C:
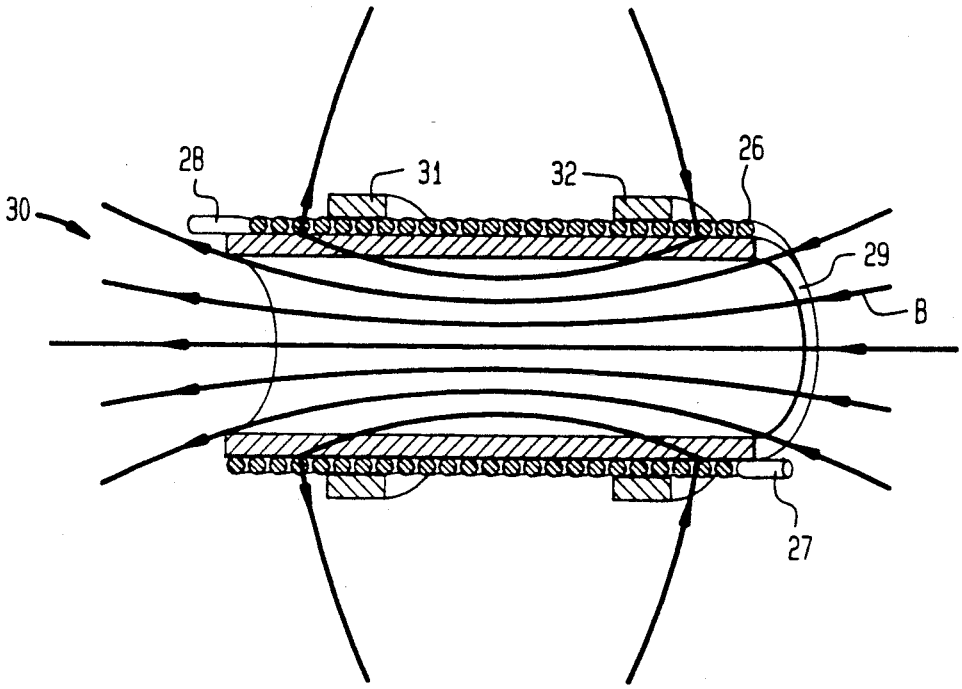
Figure 3D:
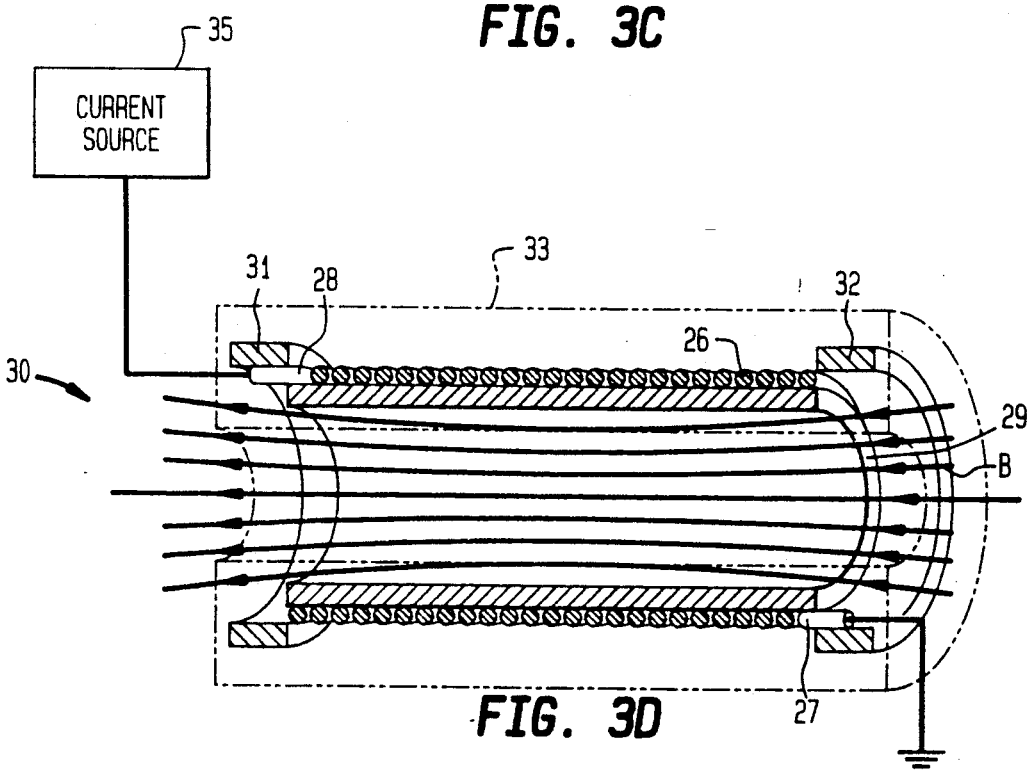

The superconducting bands 31, 32 are then separated and moved to the ends of the coil 26 FIGS. 3B–3D. As the superconducting bands 31, 32 are moved along coil 26, the flux lines exterior of the bands 31, 32 will not be capable of penetrating the bands 31, 32. As such, the bands 31, 32 will cause a reshaping of the flux lines in the manner shown in FIGS. 3B–3D. When the bands 31, 32 are placed at opposite ends of the coil 26 (FIG. 3D), there will be substantially no flux lines passing through the sides of the coil 26. Virtually all of the flux can be made to pass through the ends of the coil 26, thereby straightening the flux at the interior of coil 26 to more closely approximate the uniform flux lines of an infinite coil.

There will be a persistant current flow in the superconducting bands 31, 32 after the superconducting state is switched on. The current in superconducting bands 31, 32 will not be great, however, because the current passing through coil 26 will produce most of the flux. The shorter the length of the coil 26 the greater will be the current burden on the superconducting bands 31, 32.

The current in bands 31, 32 can be reduced by using an alternate procedure as follows: Initially, the bands 31, 32 are placed in a non-superconductive state by raising the temperature of the bands 31, 32 above the superconductive critical temperature Tc. The current in coil 30 is then brought up to its desired or working value to produce a field which will at least be below the critical field Hc. The temperature of bands 31, 32 is now lowered below the critical temperature Tc, thereby causing bands 31, 32 to become superconductive and trapping whatever flux was threading the bands 31, 32 at transition. The bands 31, 32 are then moved to opposite ends of the coil 30, straightening the flux lines B in the process.

In this alternate procedure, the amount of flux trapped in the bands 31, 32 will correspond to the lower-valued working field produced by coil 30. In the first-described procedure, the trapped flux corresponded to the flux produced at the higher-valued critical field Hc. Clearly, in the first-described procedure, the trapped flux will be greater, making the corresponding currents in bands 31, 32 greater.

If they are made of conventional superconductive materials, the bands 31, 32 must be cooled below their critical temperature Tc by special coolants such as liquid nitrogen. To accomplish the necessary cooling, an insulating housing 40 (FIG. 3D), made of styrofoam or like material may be closely placed about the coil 26, the form 27, and the bands 31, 32 to contain the coolant. The housing 40 can provide a central working space in which the near-uniform field is located.

It should be understood, of course, that the foregoing disclosure relates to only a preferred embodiment of the invention and that numerous modifications and alterations may be made therein. For example, the superconducting bands 31, 32 may be used to reshape magnetic fields produced by magnets having a variety of shapes. The superconducting bands 31, 32 may be used with permanent magnets as well as electromagnets. When used with permanent magnets, the field of the permanent magnet must be less than the critical field Hc. In this case, the previously described temperature switching is possible or an external field source may be used to switch off the superconductive state of the bands 31, 32. Of course, an external field source may also be used with the electromagnet 30 to perform magnetic switching of the superconductive state if it is desirable to limit the magnitude of the current in coil 26 below the value that would be necessary to exceed the critical field Hc. Of course other alterations and modifications will become obvious to those skilled in these arts. It is therefore to be understood, that within the scope of the appended claims, the invention may be practical otherwise than as specifically described.

What is claimed is:

1. A longitudinal magnetic field source comprising:

a cylindrically shaped solenoid having a longitudinal axis, a center, first and second ends and an outer surface, the solenoid generating a magnetic field;

at least a first and second cylindrical bands slidably mounted coaxially on the outer surface of the solenoid, the first and second bands being made of superconducting material; and means for switching the first and second bands from a non-superconducting state to a superconducting state;

wherein the first and second bands are in a non-superconducting state and positioned at the center of the solenoid and thereafter the bands are switched to a superconducting state and then the first and second bands are moved in opposite directions toward the opposite ends of the solenoid.

2. The magnetic field source of claim 1 wherein the means for switching the first and second bands from a non-superconducting state to a superconducting state is accomplished by raising the magnetic field of the solenoid adjacent said bands above the superconducting critical field of said bands.

3. The magnetic field source of claim 2 wherein the solenoid is a coil and the means for switching the first and second bands from a non-superconducting state to a superconducting state is accomplished by conducting a current of a sufficient magnitude through said coil to raise said magnetic field above a superconducting critical field.

4. The magnetic field source of claim 1 wherein the means for switching the first and second bands from a non-superconducting state to a superconducting state is accomplished by lowering the temperature of the first and second bands below the superconductive critical temperature of the first and second bands.

* * * * *